United States Patent [19]

Sato et al.

[11] Patent Number: 4,597,724

[45] Date of Patent: Jul. 1, 1986

[54] SCROLL TYPE FLUID DISPLACEMENT APPARATUS WITH CENTRIFUGAL FORCE BALANCEWEIGHT

[75] Inventors: Tadashi Sato; Kiyoshi Terauchi, both of Gunma, Japan

[73] Assignee: Sanden Corporation, Gunma, Japan

[21] Appl. No.: 613,418

[22] Filed: May 24, 1984

[30] Foreign Application Priority Data

May 24, 1983 [JP] Japan ..... 53-90993

[51] Int. Cl.[4] ..... F01C 1/04; F01C 17/06; F01C 21/00

[52] U.S. Cl. ..... 418/55; 418/57; 418/151

[58] Field of Search ..... 418/55, 151, 57

[56] References Cited

U.S. PATENT DOCUMENTS

| | | | |
|---|---|---|---|
| 3,874,827 | 4/1975 | Young | 418/151 |
| 3,924,977 | 12/1975 | McCullough | 418/55 |
| 3,986,799 | 10/1976 | McCullough | 418/55 |
| 3,994,633 | 11/1976 | Shaffer | 418/55 |
| 3,994,636 | 11/1976 | McCullough et al. | 418/55 |
| 4,082,484 | 4/1978 | McCullough | 418/55 |
| 4,406,600 | 9/1983 | Terauchi et al. | 418/55 |
| 4,439,118 | 3/1984 | Iimori | 418/55 |

FOREIGN PATENT DOCUMENTS

| | | | |
|---|---|---|---|
| 56-129791 | 10/1981 | Japan | 418/55 |
| 57-148091 | 9/1982 | Japan | 418/151 |
| 57-148092 | 9/1982 | Japan | 418/151 |
| 58-65985 | 4/1983 | Japan . | |
| 58-62396 | 4/1983 | Japan . | |
| 58-62301 | 4/1983 | Japan . | |
| 58-67903 | 4/1983 | Japan . | |

*Primary Examiner*—John J. Vrablik

*Attorney, Agent, or Firm*—Banner, Birch, McKie & Beckett

[57] ABSTRACT

A scroll type fluid displacement apparatus is disclosed. The scroll type fluid displacement apparatus includes a housing, a fixed scroll and an orbiting scroll both of which having an end plate from which wrap extends. Both wraps interfit to make a plurality of line contacts to define at least one sealed off fluid pocket. A drive shaft is rotatably supported by the housing, and has a drive pin which is radially offset from the axis of the drive shaft. The end plate of orbiting scroll has a boss, and a bushing is rotatably supported within the boss. The bushing has an eccentric hole disposed eccentrically with respect to the center of the bushing, and the drive pin is inserted in the eccentric hole. The bushing also has a balanceweight which causes a centrifugal force which is slightly larger than the centrifugal force which arises by orbital motion of the orbiting scroll and other orbital parts to improve the wearing of the wrap in the high speed operation of the apparatus.

6 Claims, 9 Drawing Figures

SCROLL TYPE FLUID DISPLACEMENT APPARATUS WITH CENTRIFUGAL FORCE BALANCEWEIGHT

TECHNICAL FIELD

This invention relates to fluid displacement apparatus, and more particularly, to a scroll type fluid displacement apparatus.

BACKGROUND OF THE INVENTION

Scroll type fluid displacement apparatus are well known in the prior art. For example, U.S. Pat. No. 801,182 discloses a fluid displacement device which includes two scrolls each having a circular end plate and a spiroidal or involute spiral element. These scrolls are maintained angularly and radially offset so that both spiral elements interfit and make a plurality of line contacts between their spiral curved surfaces to thereby seal off and define at least one pair of fluid pockets. The relative orbital motion of the two scrolls shifts the line contacts along the spiral curved surfaces and, as a result, the volume of the fluid pockets changes. Since the volume of the fluid pockets increases or decreases dependent on the direction of the orbital motion, the scroll type fluid displacement apparatus is applicable to compress, expand or pump fluids.

In comparison with conventional compressors of the piston type, a scross type compressor has certain advantages such as fewer number of parts, and continuous compression of fluid. However, there have been several problems, primarily sealing of the fluid pockets and wearing of spiral elements; particularly since sealing of the fluid pockets must be balanced with wear of the contacting surfaces. It is desirable in a scroll type compressor to maintain sufficient sealing force at the line contacts because the fluid pockets are defined by the line contacts between the spiral elements, and the line contacts shift along the surface of spiral elements towards the center of spiral elements by the orbital motion of the scroll, to thereby move the fluid pockets to the center of the spiral elements with consequent reduction of volume and compression of the fluid in pockets. On the other hand, if the contact force between the spiral elements becomes too large in maintaining the sealing of the line contacts, wear of spiral elements' surfaces increases.

In particular, if the scroll type compressor is driven at high speed, the orbiting spiral element strongly pushes against the other spiral to thereby increase the driving force of the compressor and cause abrasion dust. This abrasion dust has a detrimental influence on the compressor or the refrigerating system used with the compressor. Mechanical efficiency of the compressor is also reduced by such abrasion dust.

SUMMARY OF THE INVENTION

It is a primary object of this invention to provide an improvement in a scroll type fluid displacement apparatus which has excellent sealing of the fluid pockets and resistance to wearing of the spiral elements' surfaces at high driving speeds.

It is another object of this invention to provide a scroll type fluid displacement apparatus which holds its dynamic balance and, therefore, prevents vibration of the apparatus.

It is still another object of this invention to provide a scroll type fluid displacement apparatus which is simple in construction and production and which achieves the above described objects.

A scroll type fluid displacement apparatus according to this invention includes a housing having a fluid inlet port and fluid outlet port. A fixed scroll is fixedly disposed relative to the housing and has a first circular end plate from which a first wrap extends. An orbiting scroll has a second circular end plate from which a second wrap extends. The first and second wraps interfit at an angular offset of 180° and predetermined radial offset to make a plurality of line contacts which define at least one sealed off fluid pocket. A driving mechanism, which includes a drive shaft rotatably supported by the housing and a drive pin extending from an eccentric location at the inner end of the drive shaft, is operatively connected to the orbiting scroll for transmitting the orbital motion. A rotation preventing mechanism is disposed in the housing for preventing the rotation of the orbiting scroll during its orbital motion, so that the fluid pockets change volume due to the orbital motion of the orbiting scroll. The second end plate of the orbiting scroll is drivingly connected to the drive pin through a linkage member. The linkage member has a balanceweight which generates a centrifugal force that opposes the centrifugal force due to orbital motion the orbiting scroll and parts of the apparatus. The magnitude of the centrifugal force generated by the balanceweight is slightly higher than the centrifugal force due to the orbital motion of the orbiting scroll and the parts of the apparatus which orbit with it.

DETAILED DESCRIPTION OF THE PREFERRED EMBODIMENTS

Figure 1:
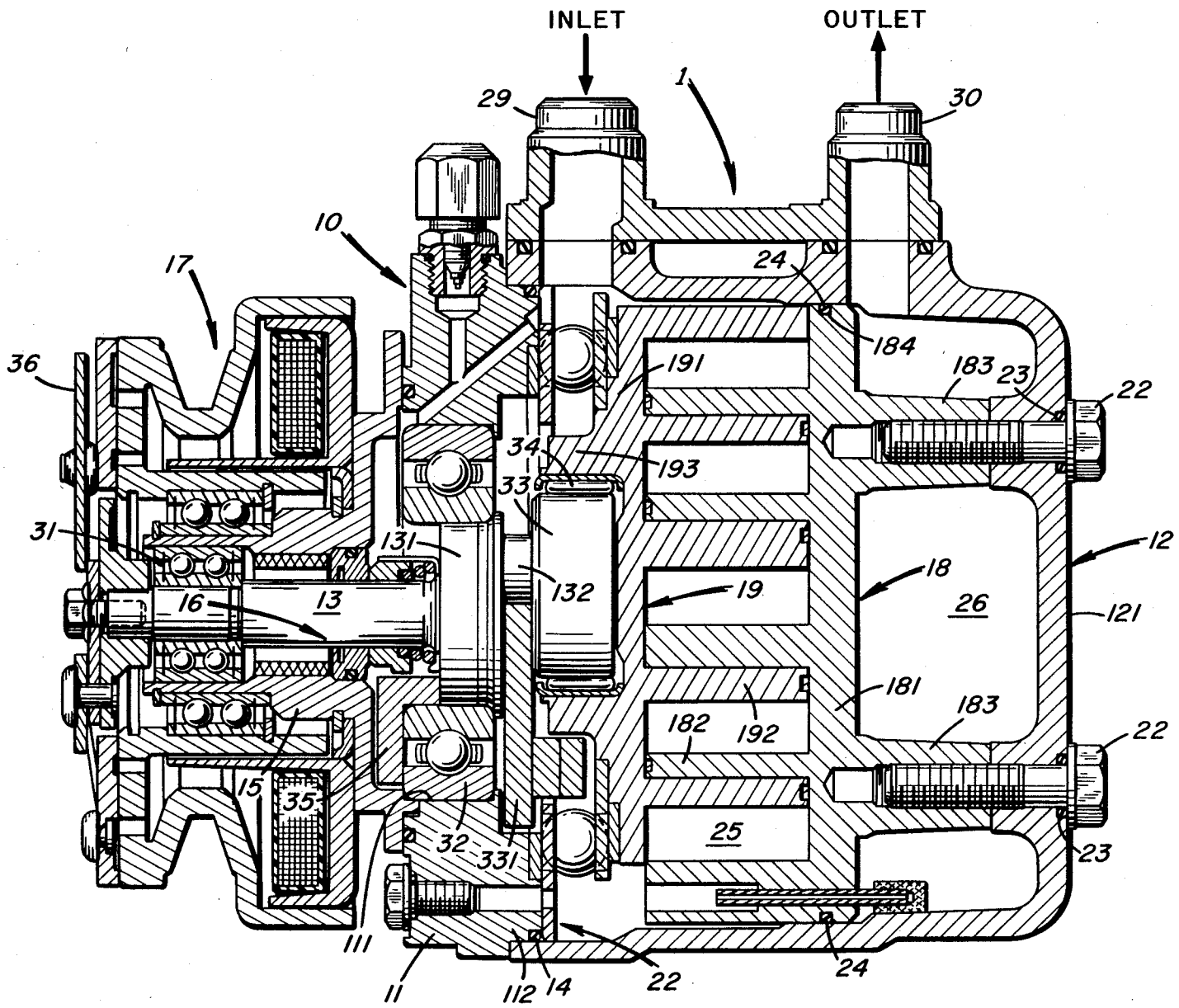
FIG. 1 is a vertical sectional view of a compressor unit of the scroll type according to an embodiment of this invention.

Referring to FIG. 1, an embodiment of a fluid displacement apparatus in accordance with the present invention, in particular a refrigerant compressor unit 1 is shown. The compressor unit 1 includes a compressor housing 10 having a front end plate 11 and a cup shaped casing 12 which is attached to one side surface of front end plate 11. An opening 111 is formed in the center of front end plate 11 for the penetration or passage of a drive shaft 13. An annular projection 112, concentric with opening 111, is formed on the inside surface of front end plate 11 and projects toward cup shaped casing 12. An outer peripheral surface of projection 112 contacts an inner wall surface of cup shaped casing 12. The open portion of cup shaped casing 12 is thereby covered and closed by front end plate 11. An O-ring 14 is placed between the outer peripheral surface of front end plate 11 and the inner wall surface of cup shaped casing 12, to thereby secure a seal between the fitting or mating surfaces of front end plate 11 and cup shaped casing 12.

Front end plate 11 has an annular sleeve portion 15 projecting outwardly from the front or outside surface thereof. Sleeve 15 surrounds drive shaft 13 and defines a shaft seal cavity. A shaft seal assembly 16 is fixed on drive shaft 13 within the shaft seal cavity of front end plate 11. In the embodiment shown in FIG. 1, sleeve portion 15 is fixed to front end plate 11 by fastening means, such as screws (not shown). Alternatively, the sleeve portion 15 may be formed integral with front end plate 11.

Drive shaft 13 is coupled to an electromagnetic clutch 17 which is disposed on the outer portion of sleeve portion 15. Thus, drive shaft 13 is driven by an external power source, for example, a motor of a vehicle, through a rotation force transmitting means, such as electromagnetic clutch 17.

A fixed scroll 18, an orbiting scroll 19, a driving mechanism for orbiting scroll 19 and rotation preventing/thrust bearing means 22 for orbiting scroll 19 are disposed in the inner chamber of cup shaped casing 12. The inner chamber is formed between the inner wall of cup shaped casing 12 and front end plate 11.

Fixed scroll 18 includes a circular end plate 181 and a wrap or spiral element 182 affixed to or extending from one major side surface of circular end plate 181. Circular end plate 181 of fixed scroll 18 is formed with a plurality of legs 183 axially projecting from its other major side surface, as shown in FIG. 1.

An axial end surface of each leg 183 is fitted against the inner surface of a bottom plate portion 121 of cup shaped casing 12 and fixed by screws 22 which screw into legs 183 from the outside of bottom plate portion 121. A first sealing member 23 is disposed between the outer surface of bottom plate portion 121 and the head portion of screws 22, to thereby prevent fluid leakage along screws 22. A groove 184 is formed on the outer peripheral surface of circular end plate 181 and a second seal ring member 24 is disposed therein to form a seal between the inner surface of cup shaped casing 12 and the outer pheripheral surface of circular end plate 181. Thus, the inner chamber of cup shaped casing 12 is partitioned into two chambers by circular end plate 181; a rear or discharge chamber 26, in which legs 183 are disposed, and a front or suction chamber 25, in which spiral element 181 of fixed scroll 18 is disposed.

Orbiting scroll 19 is disposed in front chamber 25. Orbiting scroll 19 also comprises a circular end plate 191 and a wrap or spiral element 192 affixed to or extending from one side surface of circular end plate 191. Spiral elements 182 and 192 interfit at an angular offset of 180° and a predetermined radial offset. A pair of fluid pockets are thereby defined between spiral elements 182 and 192. Orbiting scroll 19, which is connected to a drive mechanism and to a rotation preventing/thrust bearing means 22, is driven in an orbital motion at a circular radius Ro by the rotation of drive shaft 13 to thereby compress fluid in the fluid pockets passing through the compressor.

Generally, radius Ro of orbital motion is given by $$\frac{\text{(pitch of spiral element)} - 2\text{(wall thickness of spiral element)}}{2}$$

Figure 9:
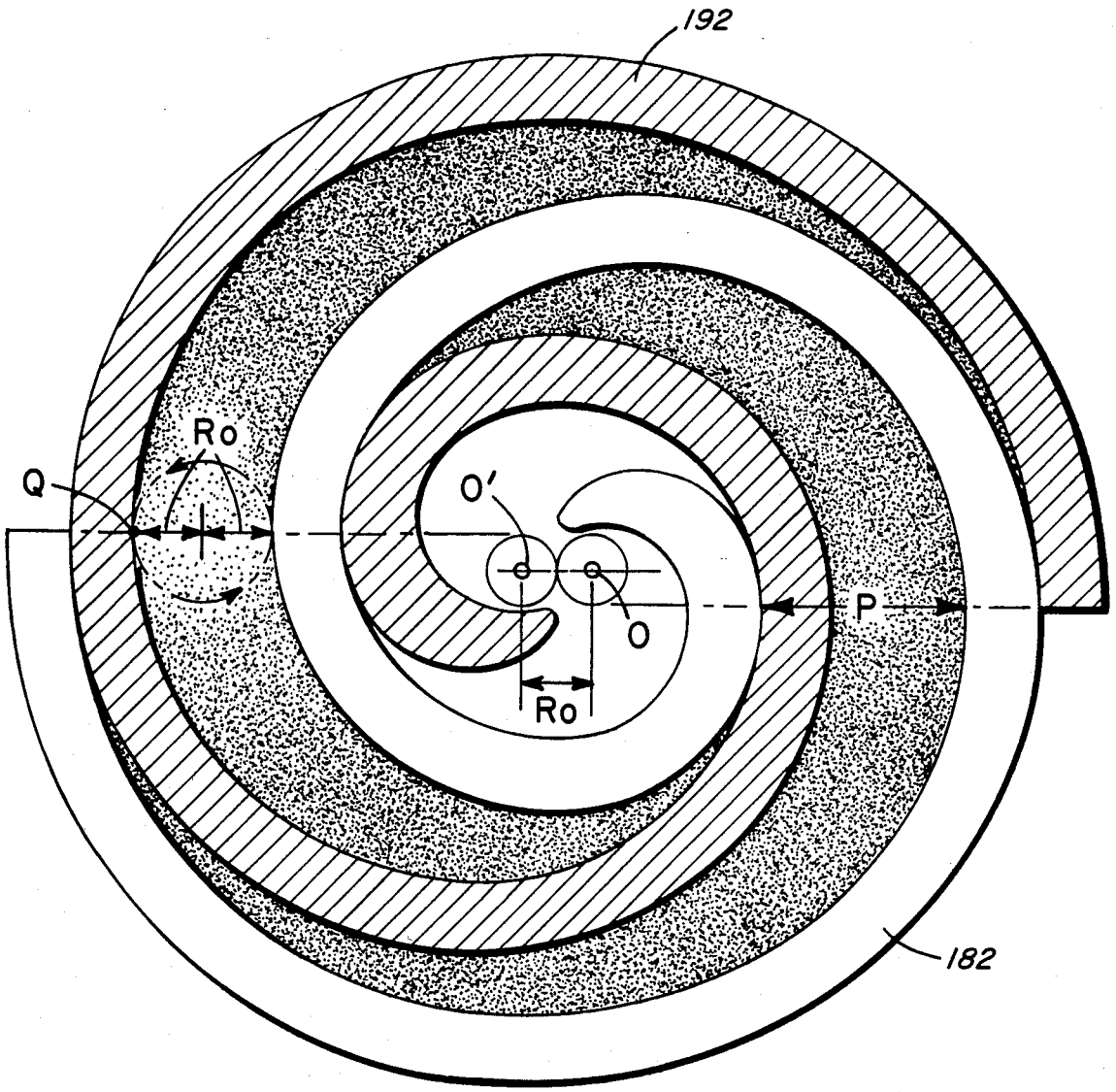
FIG. 9 is a diagrammatic sectional view illustrating the spiral elements of the fixed and orbiting scrolls.

As seen in FIG. 9, the pitch (p) of the spiral elements can be defined by $2\pi rg$, where rg is the involute generating circle radius. The radius of orbital motion Ro is also illustrated in FIG. 9 as a locus of an arbitrary point Q on orbiting scroll 19. Center O' of spiral element 192 is placed radially offset from an involute center O of spiral element 182 of fixed scroll 18 by the distance Ro. Thereby, orbiting scroll 19 is driven in orbital motion at a radius Ro by the rotation of drive shaft 13. As orbiting scroll 19 orbits, line contacts between both spiral elements 182 and 192 shifts to the center of the spiral elements along the surface of the spiral elements. Fluid pockets defined between both spiral elements 182 and 192 move to the center with a consequent reduction of volume, to thereby compress the fluid in the pockets. Circular end plate 181 of fixed scroll 18 has a hole or discharge port (not shown) at a position near center of spiral element 182 to connect discharge chamber 26 with the fluid pocket. Therefore, fluid or refrigerant gas, which is introduced into suction chamber 25 from an external fluid circuit through an inlet port 29 formed on cup shaped casing 12, is taken into fluid pockets formed between both spiral elements 182 and 192. As orbiting scroll 19 orbits, fluid in the fluid pocket is compressed and compressed fluid is discharged into discharge chamber 26 from the fluid pockets at the spiral elements' center through the discharge port, and therefrom, discharged through an outlet port 30 formed on cup shaped casing 12 to an external fluid circuit, for example, a cooling circuit.

Figure 2:
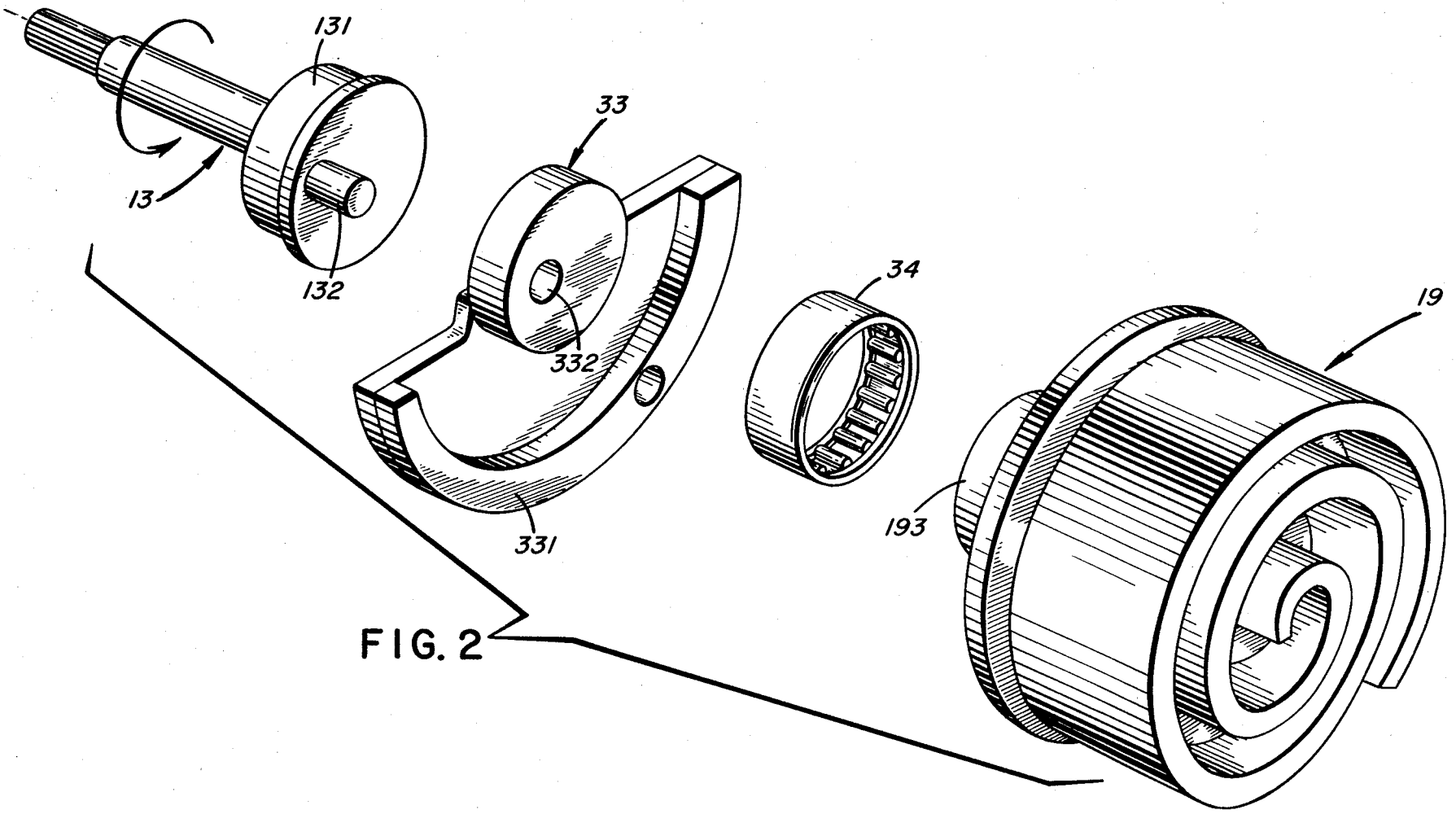
FIG. 2 is an exploded perspective view of the driving mechanism in the embodiment of FIG. 1.

Referring to FIGS. 1 and 2, the driving mechanism of orbiting scroll 19 will be described. Drive shaft 13, which is rotatably supported by sleeve portion 15 through a ball bearing 31, is formed with a disk portion 131. Disk portion 131 is rotatably supported by front end plate 11 through a ball bearing 32 disposed within opening 111 of front end plate 11.

A crank pin or drive pin 132 projects axially inward from an end surface of disk portion 131 and is radially offset from the center of drive shaft 13. Circular end plate 191 of orbiting scroll 19 is provided with a tubular boss 193 projecting axially outwardly from the end surface opposite to the side from which spiral element 192 extends. A discoid or short axial bushing 33 is fitted into boss 193, and is rotatably supported therein by a bearing, such as a needle bearing 34. Bushing 33 has a balanceweight 331 which is shaped as a portion of a disc or ring and extends radially from bushing 33 along a front surface thereof. An eccentric hole 332 is formed in bushing 33 at a position radially offset from center of bushing 33. Drive pin 132 fits into the eccentrically disposed hole 332 within which a bearing (not shown) may be applied. Bushing 33 is therefore driven in an orbital path by the revolution of drive pin 132 and can rotate within needle bearing 34. Bushing 33 thus functions as a linkage member to drivingly connect orbiting scroll 19 to drive shaft 13 and drive pin 132.

Figure 3:
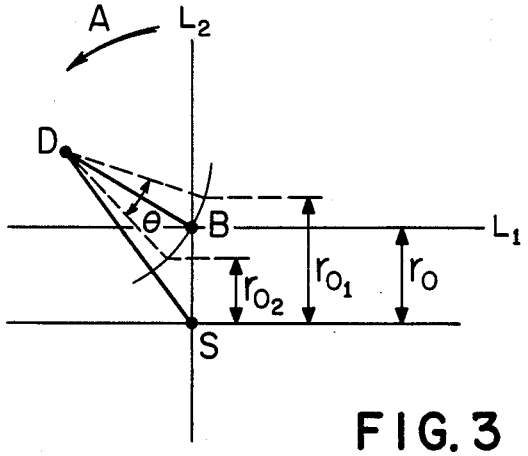
FIG. 3 is a diagram of the motion of the bushing in the embodiment of FIG. 1.

Respective placement of center S of drive shaft 13 center B of bushing 33, and center D of hole 332 and thus of drive pin 132, is shown in FIG. 3. In the position shown in FIG. 3, the distance between S and B is the radius Ro of orbital motion. When drive pin 132 is fitted into eccentric hole 332 center D of drive pin 132 is placed, with respect to S, on the opposite side of a line $L_1$, which is through center B of bushing and perpendicular to a line $L_2$ through S and B, and also beyond the line $L_2$ through B and S in the direction of rotation A of drive shaft 13. This relationship of centers D, S and B holds true in all rotative positions of drive shaft 13. As seen in FIG. 3, center D, at this particular point of motion, is located in the upper left hand quadrant defined by the lines $L_1$ and $L_2$.

In this construction of driving mechanism, center B of bushing 33 can swing about the center D of drive pin 132 at a radius $\overline{BD}$. This swing motion of center B allows orbiting scroll 19 to comprensate its motion for changes in Ro due to wear on the spiral elements 182, 192 or due to other dimensional inaccuracies of the spiral elements. When drive shaft 13 rotates, a drive force is exerted at center D of drive pin 132 and reaction force of gas compression appears at the center B of bushing 33 with forces being parallel to line $L_1$. Therefore, the arm B–D can swing outward by the creation of moment generated by both of these forces, so that spiral element 192 of orbiting scroll 19 is forced toward spiral element 182 of fixed scroll 18 and orbiting scroll 19 orbits with the radius Ro around center S of drive shaft 13. The rotation of orbiting scroll 19 is prevented by rotation preventing means 22, whereby orbiting scroll 19 orbits and keeps its relative angular relationship with fixed scroll 18.

Figure 4:
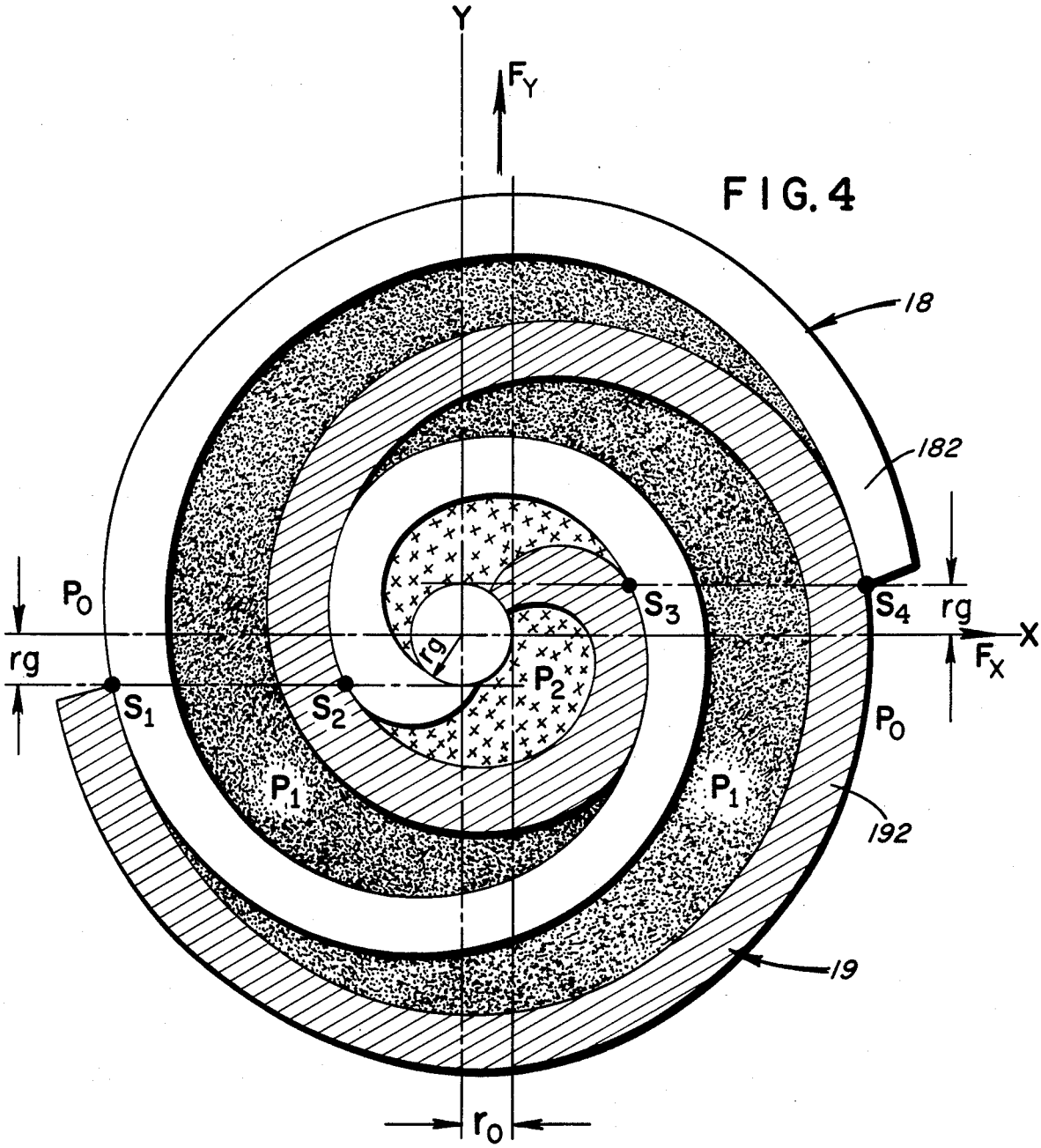
FIG. 4 is a diagrammatic sectional view of the wraps illustrating the forces that act on the orbiting scroll.
Figure 5:
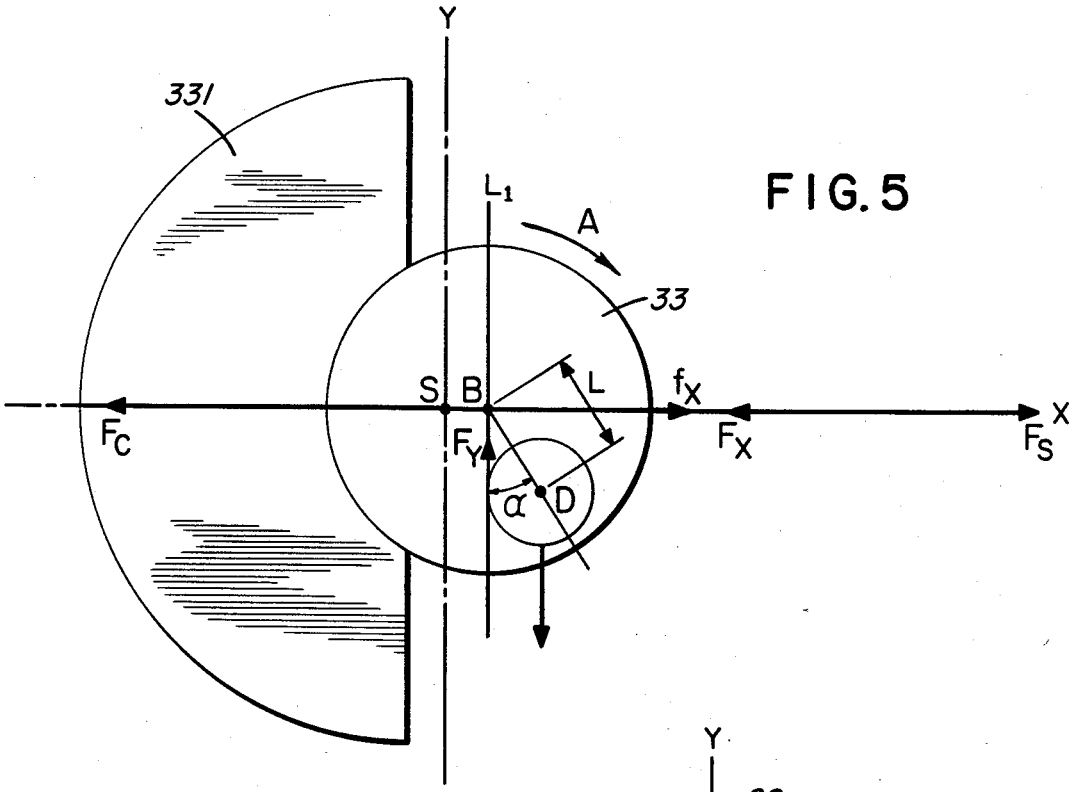
FIG. 5 is explanatory view of the bushing illustrating the forces that act on the bushing.

Referring to FIGS. 4 and 5, an analysis of the forces exerted on bushing 33 will be described. As shown in FIG. 4, the line contacts $S_1$, $S_2$, $S_3$ and $S_4$ between spiral elements 182 and 192 which define the sealed off fluid pockets are offset on opposite sides of the scroll center line due to the way involutes are generated. Therefore, a radial component force Fx of gas compression force occurs and acts on the area defined as 2·rg·H, where H is height of spiral element and rg is radius of the involute generating circle. The radial component force Fx is thus given by the following formula:

$$\begin{aligned} Fx &= 2 \cdot rg \cdot H \cdot (P2 - P1) + 2 \cdot rg \cdot H \cdot (P1 - P0) \\ &= 2 \cdot rg \cdot H \cdot (P2 - P0) \end{aligned}$$

where P2 is pressure of central fluid pocket, P0 is pressure of suction chamber, and P1 is pressure of intermediate fluid pockets.

Figure 6:
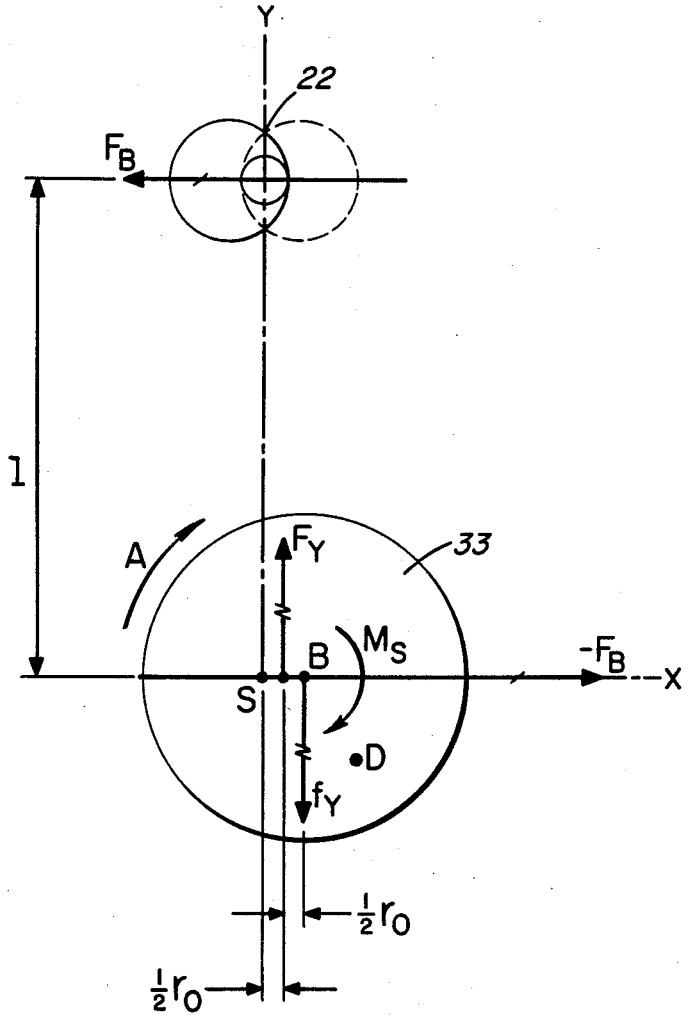
FIG. 6 is a diagram illustrating the generation of a rotating moment and the operation of the rotation preventing mechanism in the embodiment of FIG. 1.

The tangential component force Fy is force which results in the gas compression torque T of drive shaft 13, whereby tangential force Fy is defined as Fy=T/RO. As orbiting scroll 19 orbits, reaction force fy of the tangential component force Fy appears at the center B of bushing 33, as shown in FIG. 6. Since bushing 33 is rotatable on drive pin 132, bushing 33 is subject to a rotating moment generated by the tangential force Fy around center D of drive pin 132. This rotating moment is defined as Fy·L·Sinα, where α is the angle between the line D-B and line $L_1$, and L is distance between center D of drive pin 132 and center B of bushing 33. Orbiting scroll 19 which is supported by bushing 33 is also subject to the rotating moment with radius L around center D of drive pin 132 and, hence, the rotating moment is also transferred to spiral element 192 of orbiting scroll 19. This moment urges spiral element 192 against spiral element 182 with an urging force fx. This urging force fx is defined as follows:

$$fx \cdot L \cdot \cos\alpha = Fy \cdot L \cdot \sin\alpha$$

$$fx = Fy \cdot \tan\alpha$$

Referring to FIG. 6, the tangential component force Fy appears at midpoint of distance S-B and reaction force fy is exerted at center B of the bushing, so that a rotating moment Ms is generated by the offset of the acting point of the tangential force and the supporting point or rotating points of the orbiting scroll. The rotation preventing mechanism receives the rotating moment Ms, and thus a reaction force $-F_B$ appears at the bushing.

As shown in FIG. 5, bushing 33 also receives a centrifugal Force $F_S$ generated by the orbital motion of orbiting scroll 19, bearing 34 and part of bushing 33, and a centrifugal force $F_C$ generated by the rotation of counter weight 331 of bushing 33. These forces along the X-axis (line $L_2$) results in a radial component sum total force $\Sigma X_F$ which is defined as $\Sigma X_F = fx - F_B + F_S - F_C - F_X$ which acts on spiral element 192 of orbiting scroll 19. Therefore, if this sum total force $\Sigma X_F$ is set over zero (0) ($\Sigma X_F > 0$), spiral element 192 of orbiting scroll 19 is urged against spiral element 182 of fixed scroll 18. Prior apparatus usually operated under such a condition. However, this invention sets the centrifugal force $F_C$ slightly larger than the centrifugal force Fs, so that if the contact force fx is excluded from the summation, $\Sigma X_F = 0$ or $\Sigma X_F < 0$ at the maximum rotational speed of the apparatus. Wearing of the spiral element due to excessive contact of the spiral elements is thus prevented.

Figure 7:
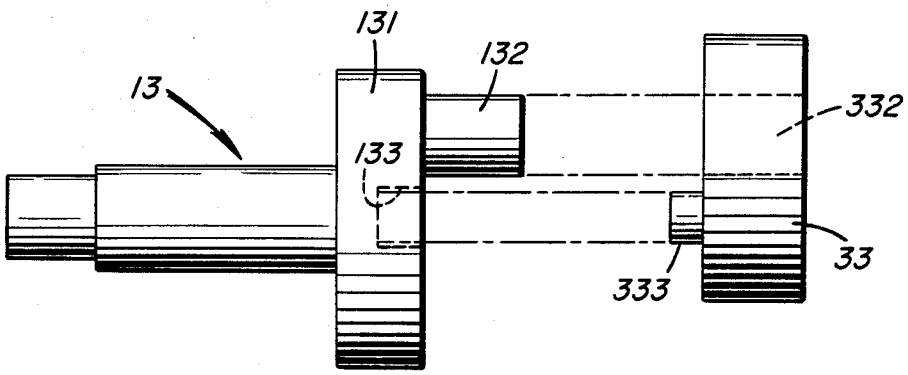
FIG. 7 is a side view of a modified driving mechanism.

It is advantageous to have bushing 33 freely rotatable on drive pin 132, so that bushing 33 is movable vertically to accommodate for dimensional errors in the spiral elements. However, if bushing 33 would be fully freely rotatable around drive pin 132, the urging force of the spiral element would decrease at high rotational speeds of the compressor. The gap between spiral elements 182 and 192 thus increases and reduces the efficiency of the compressor. Therefore, to limit the rotational movement of bushing 33 around drive pin 132, the unit is provided with a swing angle limiting mechanism which is shown in FIG. 7.

The swing angle limiting mechanism is formed as a projection, such as a pin 333, from either the bushing 33 or the disk portion 131, and a reception opening 133 for the projection in the other of bushing 33 or disk portion 131. In this embodiment, bushing 33 is provided with coupling pin 333 at its end surface and disk portion 131 has circular indentation 133 at its end surface for receiving pin 333 with a gap surrounding the pin. The reception of coupling pin 333 within indentation or opening 133 limits the amount of swing of bushing 33 to a selected degree.

As mentioned above, the magnitude of centrifugal force $F_C$ which arises due to orbiting of balanceweight 331 is slightly larger than the centrifugal force $F_S$ which arises due to orbiting of orbiting scroll 19, bearing 34 and the portion of bushing 33 excluding balanceweight 331 in order to prevent excessive contact between the spiral elements at high speed drive. Therefore, since there is a difference between centrifugal forces $F_C$ and $F_S$ an unbalance arises and vibration of the unit can occur. To prevent vibration caused by dynamic unbalance created by the difference in magnitude of the centrifugal forces, the compressor unit is provided with a cancelling mechanism which is shown in FIG. 1. Drive shaft 13 is provided with a pair of balanceweights 35 and 36. Balanceweight 35 is placed on drive shaft 13 near or adjacent to balanceweight 331 to cause centrifugal force in the same direction as the centrifugal force of balanceweight 331. Balanceweight 36 is placed on drive shaft 13 on an opposite radial side of drive shaft 13 as balanceweight 35 and on an opposite side in the axial direction relative to balanceweight 331. Balanceweight 36 causes centrifugal force Fa in an opposite direction to the centrifugal force Fb of balanceweight 35.

As shown by FIG. 1, balanceweight 35 is fixed to a front end surface of disk portion 131, and balanceweight 36 is fixed to or formed integral with parts of electromagnetic clutch 17.

Figure 8:
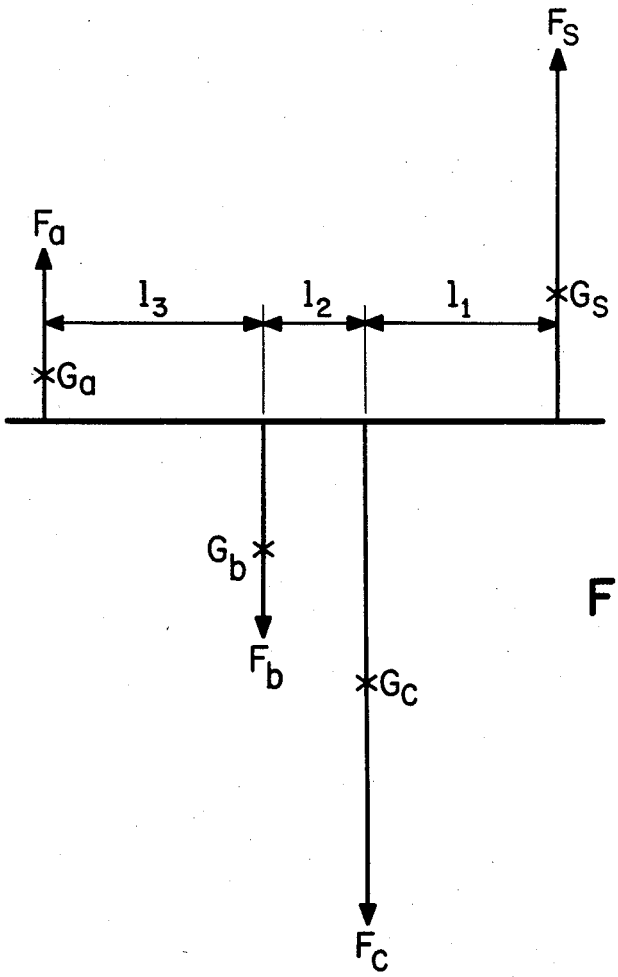
FIG. 8 is a diagram of the dynamic balance in the embodiment of FIG. 1.

Centrifugal force of balanceweight 35 and 36 is designated as Fb and Fa, respectively, and the relation of centrifugal force Fa, Fb, Fc, Fs is shown in FIG. 8. In this construction, total dynamic balance is held under the following condition:

$$Fa-Fb-Fc+Fs=0$$

$$Fb\cdot I_3Fc(I_2+I_3)-Fs(I_1+I_2+I_3)=0$$

wherein $I_1$ is distance from centroid Gs of orbiting scroll 19, bushing 33 and bearing 34 to centroid Gc of counter weight 331 along the axis of drive shaft 13, $I_2$ is distance from controid Gc of counter weight 331 to centroid Gb of balanceweight 35 along the axis of drive shaft 13, and $I_3$ is distance from centroid Gb of balanceweight 35 to centroid Ga of balanceweight 36 along the axis of drive shaft 13. In this manner, a moment created by the interaction of the centrifugal force of the orbiting scroll parts and the centrifugal force of the first balanceweight is cancelled by a moment created by the interaction of the centrifugal forces of the second and third balanceweights.

This invention has been described in detail in connection with the preferred embodiments, but these are examples only and this invention is not restricted thereto. It will be easily understood by those skilled in the art that the other variations and modifications can be easily made within the scope of this invention.

We claim:

1. In a scroll type fluid displacement apparatus including a housing having a fluid inlet port and a fluid outlet port, a fixed scroll fixedly disposed relative to said housing and having first end plate from which a first wrap extends, an orbitng scroll having second end plate from which a second wrap extends, said first and second wraps interfitting as an angular offset to make a plurality of line contacts to define at least one pair of sealed off fluid pockets, a driving mechanism including a drive shaft rotatably supported by said housing and drive pin eccentrically extending from an inner end of said drive shaft, linkage means separate from said drive shaft for drivingly connecting said drive pin to said orbiting scroll, said orbiting scroll being moved through said linkage means in orbital motion with line contact between said first and second wraps by the rotation of said drive shaft, rotation preventing means for preventing the rotation of said orbiting scroll during its orbital motion, and said linkage means being swingable about said drive pin, the improvement comprising said linkage means having a first balanceweight which causes a centrifugal force which is slightly larger than the centrifugal force which arises by orbiting motion of said orbiting scroll and the parts of the apparatus which orbit with said orbiting scroll to improve the wearing of said wraps due to radial contact between said wraps.

2. The scroll type fluid displacement apparatus of claim 1, wherein said drive shaft has a second balanceweight for causing a centrifugal force which acts in the same direction as the centrifugal force of said first balanceweight and a third balanceweight which acts in the same direction as the orbiting scroll and parts whereby the moment created by the interaction of the centrifugal force of said orbiting scroll and orbiting parts and the centrifugal force of said first balanceweight is cancelled by a moment created by the interaction of the centrifugal force of said second and third balanceweights.

3. The scroll type fluid displacement apparatus of claim 1 wherein said drive shaft and linkage means have a swing angle limiting means for restricting the angle of swing of said linkage means.

4. The scroll type fluid displacement apparatus of claim 3 wherein said swing angle limiting means is comprised of a projection extending from one of said linkage means and said inner end of said drive shaft and a reception opening formed in the other of said linkage means and said inner end of said drive shaft for receiving said projection.

5. A fluid displacement apparatus comprising:

a housing having a fluid inlet port and a fluid outlet port;

a fixed scroll fixedly disposed relative to said housing and having a first end plate from which a first wrap extends;

an orbiting scroll movably disposed within said housing and having a second end plate from which a second wrap extends, and a boss extending from an opposite surface of said second end plate, said first and second wraps interfitting at an angular offset to make a plurality of line contacts to define at least one sealed off fluid pocket;

a drive shaft rotatably supported by said housing, said drive shaft having a disk at its inner end, and clutch means coupled to its opposite end for selectively connecting said drive shaft to a power source;

a bushing having an eccentric hole and being rotatably supported in said boss;

a drive pin extending from said disk toward said bushing at a location spaced from the axis of rotation of said drive shaft, said drive pin being rotatably received within said eccentric hole of said bushing, said bushing center being spaced from said drive shaft center at a distance equal to a radius of orbital motion of said orbiting scroll, and said bushing being swingable about said drive pin;

a center of said drive pin being located with respect to the center of the drive shaft on an opposite side of a line passing through a center of said bushing and perpendicular to a connecting line passing through the center of said drive shaft and the center of said bushing, said center of said drive pin also being located beyond said connecting line in the direction of rotation of said drive shaft;

a first balanceweight extending radially from said bushing, said balanceweight having a mass and disposition to create a centrifugal force which is opposite in direction and slightly larger than the centrifugal force of said orbiting scroll and the parts of said apparatus which orbit with said orbiting scroll; and second and third balanceweights coupled to said drive shaft to cancel the moment created by the interaction of the centrifugal force of said orbiting scroll and orbiting parts and the centrifugal force of said first balanceweight by a moment created by the interaction of the centrifugal force of said second and third balanceweights.

6. A fluid displacement apparatus comprising:

a housing having a fluid inlet port and a fluid outlet port;

a fixed scroll fixedly disposed relative to said housing and having a first end plate from which a first wrap extends;

an orbiting scroll movably disposed within said housing and having a second end plate from which a second wrap extends, said first and second wraps interfitting at an angular offset to make a plurality of line contacts to define at least one sealed off fluid pocket;

a drive shaft rotatably supported by said housing, said drive shaft having a disk at its inner end, and a clutch means coupled to its opposite end for selectively connecting said drive shaft to a power source;

linkage means separate from said drive shaft for drivingly connecting said drive shaft to said orbiting scroll;

a drive pin extending from said disk toward said linkage means at a location spaced from the axis of rotation of said drive shaft, said drive pin being rotatably received within an eccentric hole of said linkage means, and said linkage means having a center spaced from said drive shaft center at a distance equal to a radius of orbital motion of said orbiting scroll and being swingable about said drive pin;

a center of said drive pin being located with respect to the center of the drive shaft on an opposite side of a line passing through the center of said linkage means and perpendicular to a connecting line passing through the center of said drive shaft and the center of said linkage means, said center of said drive pin also being located beyond said connecting line in the direction of rotation of said drive shaft;

a balanceweight extending radially from said linkage means, said balanceweight having a mass and disposition to create a centrifugal force which is opposite in direction and slightly larger than the centrifugal force of said orbiting scroll and the parts of said apparatus which orbit with said orbiting scroll.

* * * * *